United States Patent [19]

Scheuchzer et al.

[11] 4,307,667

[45] Dec. 29, 1981

[54] RAILROAD TRACK RELAYING TRAIN

[75] Inventors: Fredy Scheuchzer, Lausanne; Fritz Buhler, Ecublens, both of Switzerland

[73] Assignee: Les Fils D'Auguste Scheuchzer, S.A., Switzerland

[21] Appl. No.: 30,818

[22] Filed: Apr. 17, 1979

[30] Foreign Application Priority Data

Apr. 19, 1978 [CH] Switzerland ..... 4178/78

[51] Int. Cl.[3] ..... E01B 27/11

[52] U.S. Cl. ..... 104/2; 104/3; 104/6; 414/564; 414/754

[58] Field of Search ..... 104/2–6, 104/1 R; 414/564, 754; 105/4 R, 4 A, 215 R, 215 C

[56] References Cited

U.S. PATENT DOCUMENTS

| | | | |
|---|---|---|---|
| 2,036,535 | 4/1936 | Nelson | 105/4 R |
| 2,997,001 | 8/1961 | Scheuchzer | 104/2 |
| 3,283,926 | 11/1966 | Eckhardt et al. | 104/3 X |
| 3,699,894 | 10/1972 | Plasser et al. | 104/2 |
| 4,004,524 | 1/1977 | Scheuchzer et al. | 104/2 |
| 4,160,418 | 7/1979 | Theurer | 104/2 |

FOREIGN PATENT DOCUMENTS

| | | | |
|---|---|---|---|
| 993062 | 5/1965 | United Kingdom | 104/5 |

*Primary Examiner*—Randolph A. Reese

*Attorney, Agent, or Firm*—Robert E. Burns; Emmanuel J. Lobato; Bruce L. Adams

[57] ABSTRACT

A railroad track relaying train comprises, in addition to the cars for transporting the ballast screening machines and a car equipped with power-wrenches for fixing the tie-screws, a sequence of working cars including a tie- and rail-removing car, a ballast clearing car, and a tie and rail laying car, these cars being interconnected by means of coupling frames supported by caterpillar trucks adapted to keep the working cars on the selected path. The tie and rail removing car comprises an elevator capable of lifting and rotating at least one tie or a track span around ballast conveyors, in order to deposit at least one tie or track span upon a transport element. The train is capable of performing all of the operations necessary for removing the old track, excavating and screening the old ballast, and laying the new track on the screened ballast, without stopping its forward motion when removing the old track.

7 Claims, 12 Drawing Figures

Fig.3
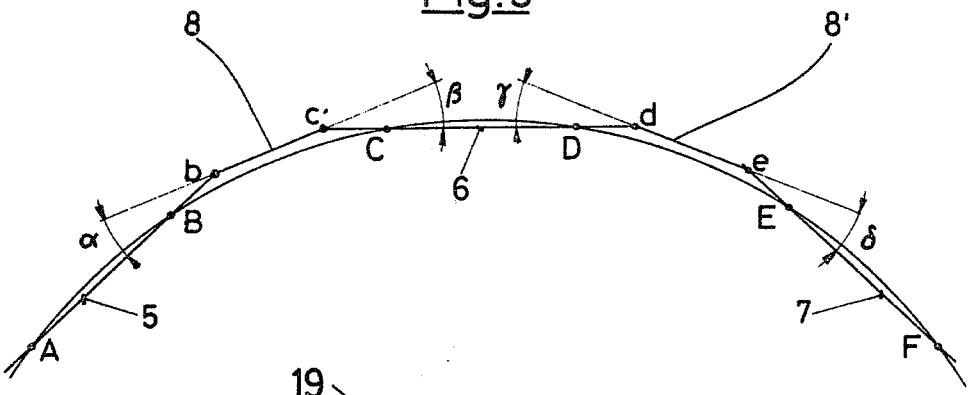
Fig.5
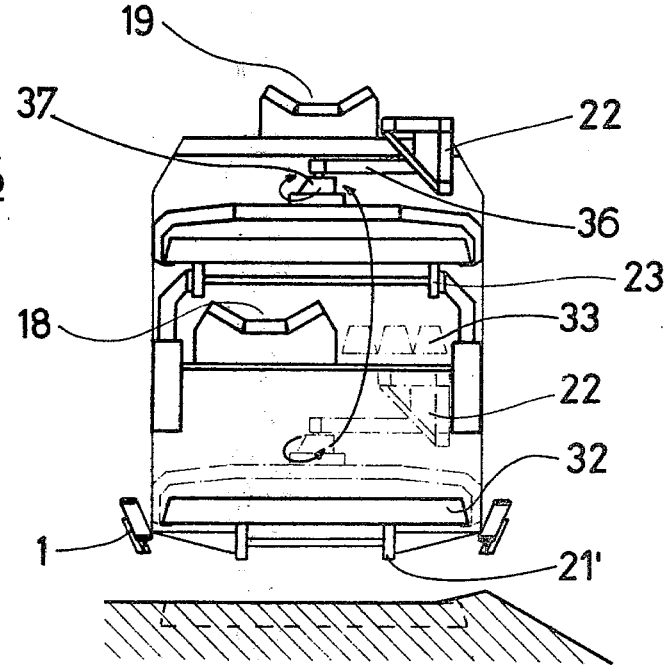
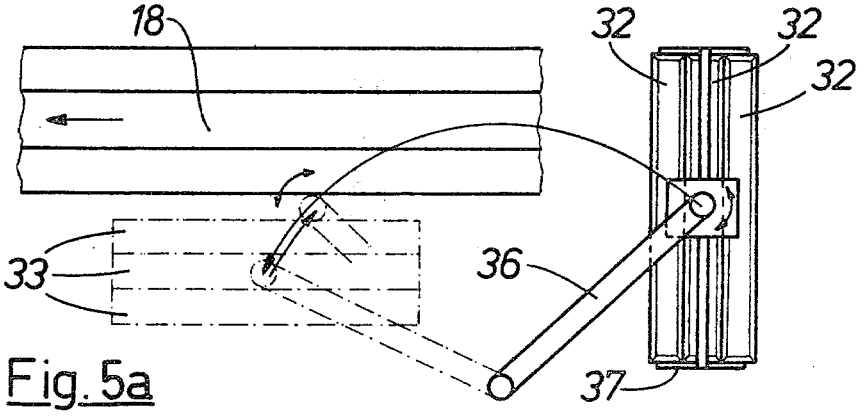
Fig.5a

RAILROAD TRACK RELAYING TRAIN

FIELD OF THE INVENTION

This invention relates to a railroad track relaying train which, in addition to cars for transporting rails, ties and their fastening means, comprises at least one sequence of working wagons including a track removing car, a ballast-clearing car, a track-laying car, a tie-screw fixing car and means for transporting the old ballast to a screener installed on a wagon outside the track-laying area, together with means for transporting the screened ballast to a storage and dispensing bin, preliminary to its distribution on the new track, and other means for transporting the old ties or track panels or spans and the new ties.

Conventionally, a railroad track relaying procedure comprises not only the substitution of new rails and ties for the old ones but also the reclaiming of the ballast, since the old ballast, soiled with dirt and refuse, is clogged and has lost the necessary elasticity and perviousness. On the other hand, the successive additions of gravel during the tie truing and ballast tamping operations are attended by an increment in the track height, and this may prove rather detrimental on railroad sections passing under fixed structures and constructions.

DESCRIPTION OF THE PRIOR ART

Nowadays, the ballast is normally cleared and screened before or after laying the new track. Therefore, the time necessary for this specific operation adds itself to the time required for performing the other track relaying operations. On the other hand, this ballast clearing and screening operation cannot be accomplished without resorting to powerful means for lifting the complete track, and this step is obviously attended by the risk of altering the shape of the new rails. Now since ballast clearing and screening machines have extremely large dimensions, putting these machines into operation involves time-robbing and complicated maneuvers both when starting and stopping their operation.

The Applicants are also the owner of the U.S. Pat. No. 4,004,524 disclosing a method for the complete relaying of a railboard track, wherein the operations consisting in removing the old track, clearing and screening the ballast and laying the new track are accomplished during a single passage of the complete track relaying train provided for this purpose. The same Swiss patent also describes a train for the complete relaying of a railroad track, which comprises not only the cars for transporting the rails, ties and their fixation means, but also at least one sequence of working cars provided with gantries for removing and laying railroad tracks, and frame-cars, such sequence being already known through Swiss Pat. Nos. 549.692 and 585.814 also owned by the Applicants. The equipments of this known track relaying train comprise inter alia means for clearing the ballast and transporting same to a screener mounted on a car located outside the track relaying area.

SUMMARY OF THE INVENTION

It is the essential purpose of this invention to provide an improved railroad track relaying train whereby all the operations consisting in removing the old ties and rails, and the excavation of the worn ballast, as well as the laying of new ties and new rails, are accomplished without stopping the machine and simultaneously with the removal of the old ties and rails, and in such a way that the train will still better fit within the maximal permissible moving dimensions while increasing the width of the working cars and reducing their wheelbase.

These improvements together with other advantageous features to be described presently are obtained by providing on the track removing car a lifting system capable of lifting and turning at least one tie or track panel around at least one of the ballast transport elements, by interconnecting the working cars by means of coupling frames supported by special trucks adapted to travel on the ballast and/or on the cleared track platform or sub-grade, or on the screened ballast, and adapted to be lowered more or less in relation to the relevant coupling frames, so as to raise the bogie-trucks of the working cars in the working area, and finally by the fact that each coupling frame interconnects two adjacent cars through the medium of universal joints and guide members for the purpose of maintaining the position of the working car concerned in relation to the coupling frame.

BRIEF DESCRIPTION OF THE DRAWINGS

FIG. 3 illustrates the geometrical inscription of the train in a curve.

FIGS. 5 and 5*a* are a cross sections of this car and a plane view from above showing the path of the tie movement, respectively.

DESCRIPTION OF THE PREFERRED EMBODIMENTS

Figure 4:
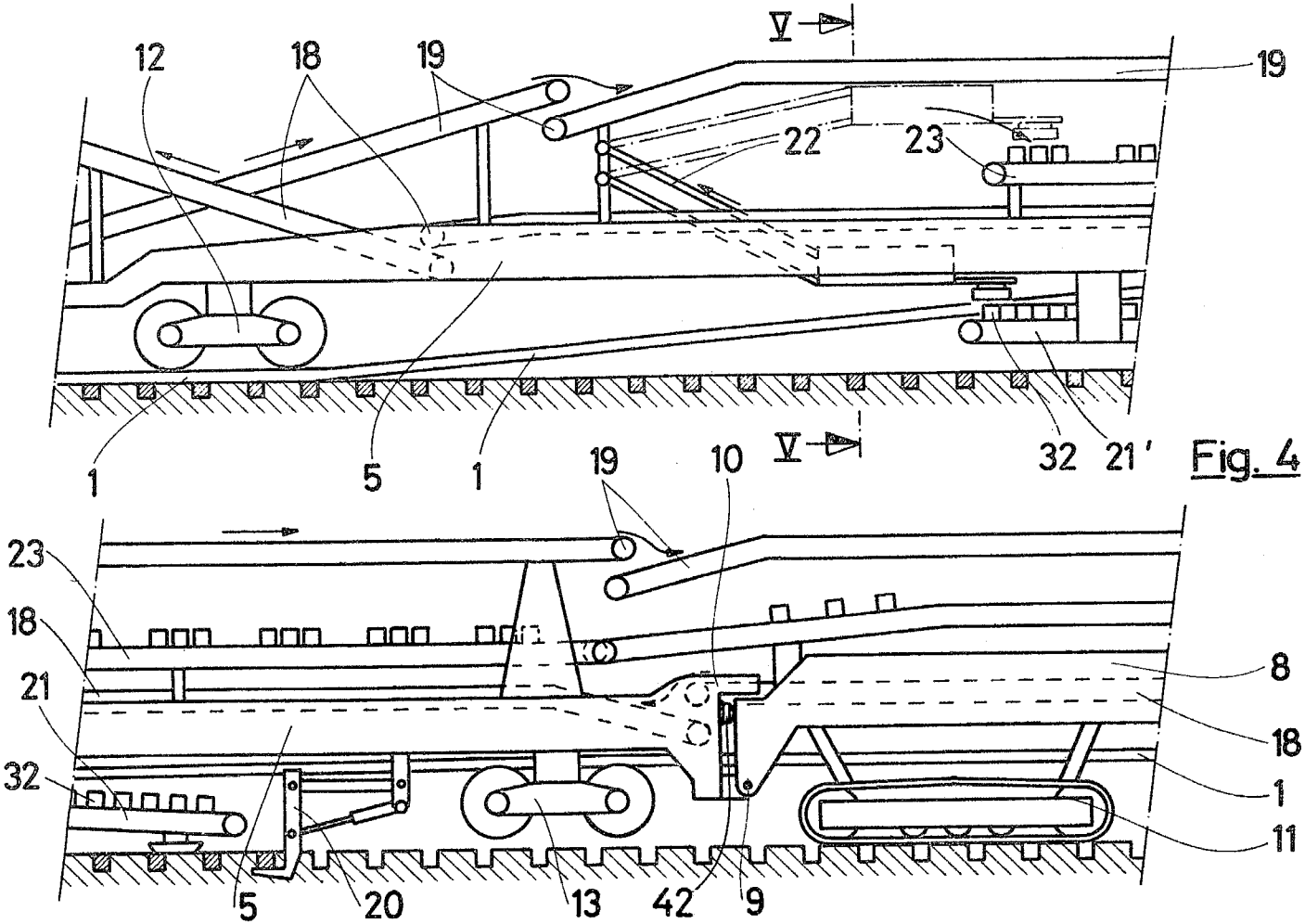
FIG. 4 is a fragmentary side elevational view of a track removing car with its tipping elevator.
Figure 6:
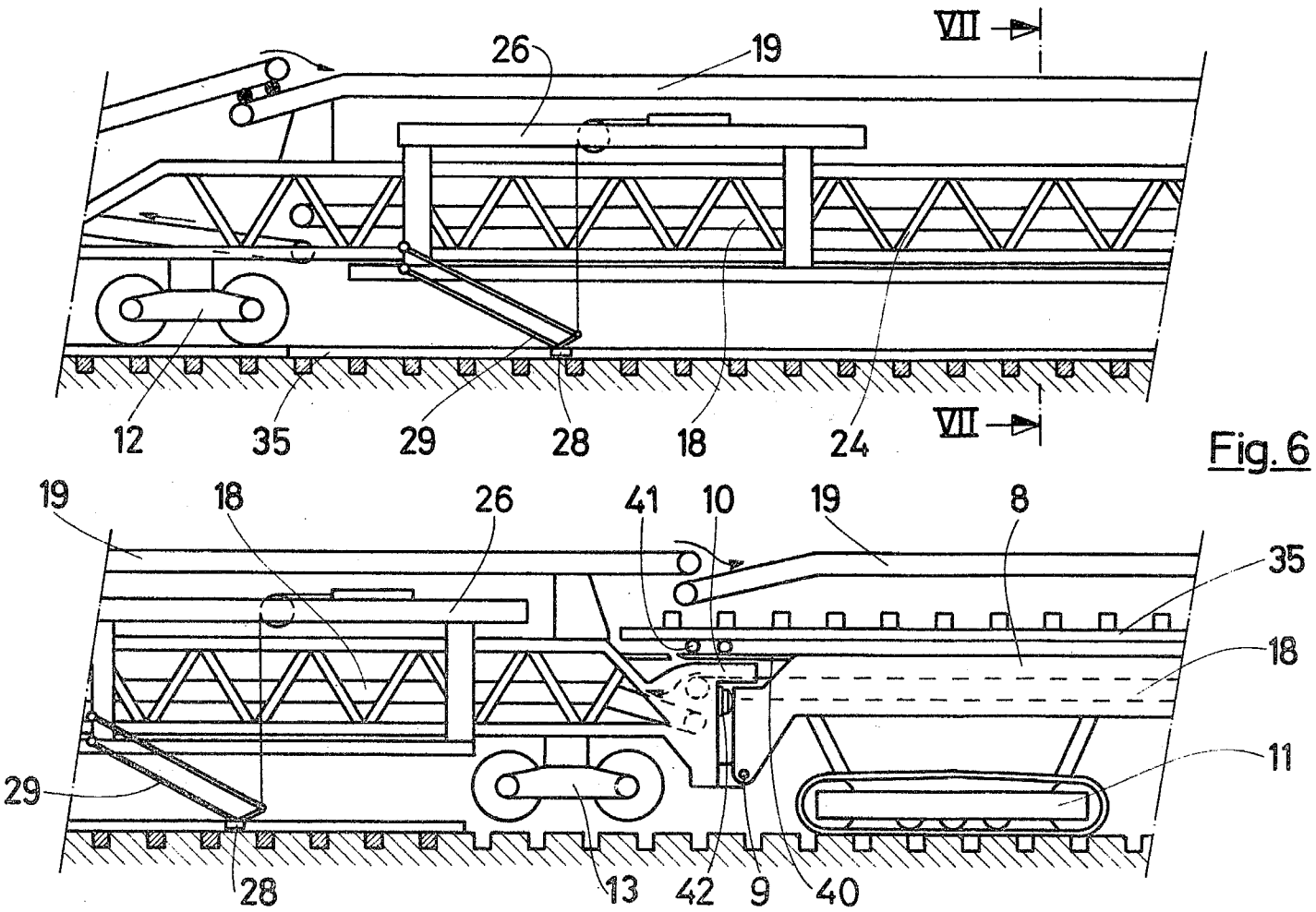
FIG. 6 is another fragmentary side-elevational view showing a modified form of embodiment of the track removing car for removing complete track panels.
Figure 7:
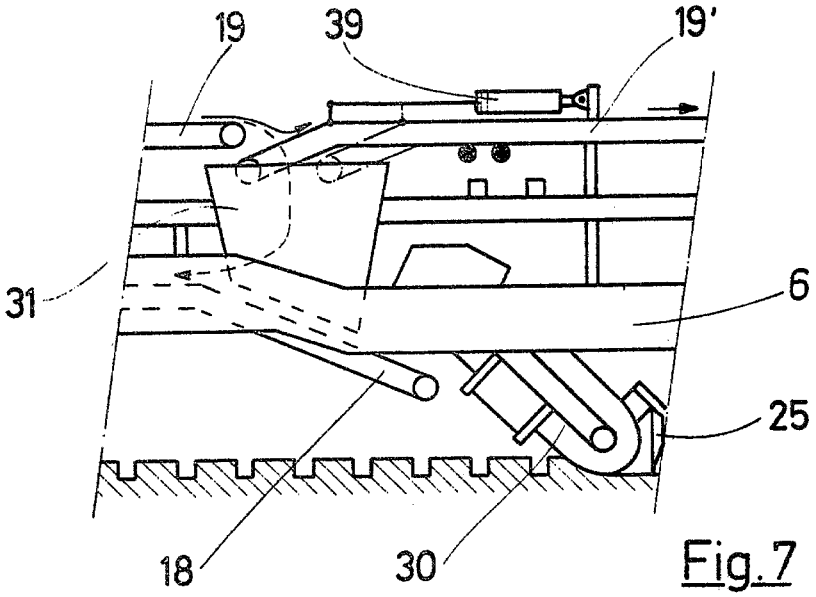
FIG. 7 is a detail view showing the coupling between the means transporting the screened ballast and the used or old ballast, respectively.
Figure 9:
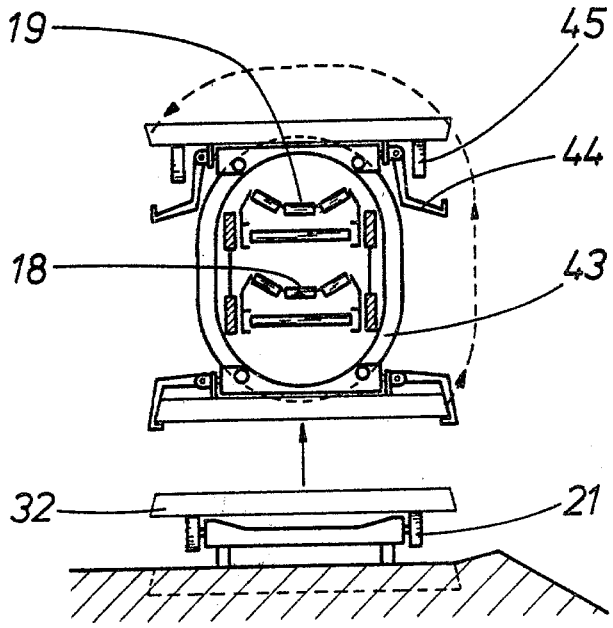
FIG. 9 is a cross section showing a modified form of embodiment of the track removing car with its rotary elevator for ties.

The railroad track relaying train according to this invention may be constructed for carrying out two different methods of removing the old ties and the old rails:

1. A method for removing and loading only the old ties (FIGS. 4, 5 and 9). The old rails 1 are spread apart and laid behind the machine either on the shoulder of the bedding or along the track axis. They are discharged at the end of the relaying operations.

Figure 8:
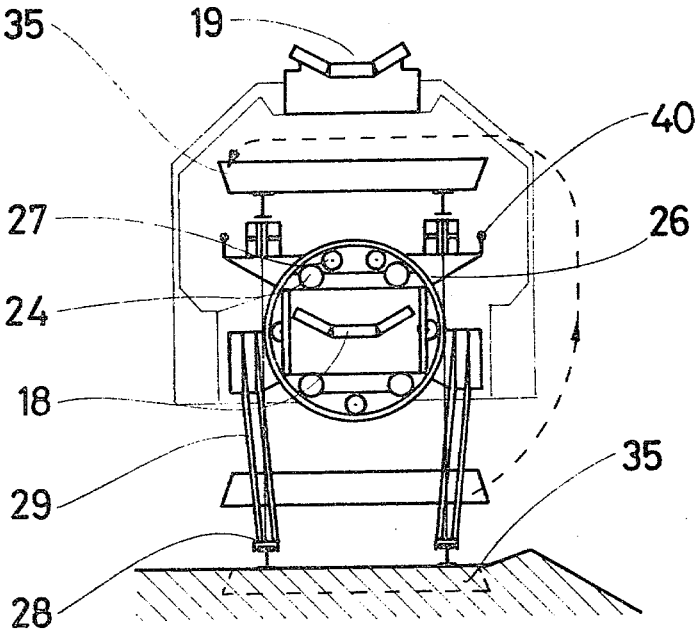
FIG. 8 illustrates in cross-section the movement of the track panel.
Figure 11:
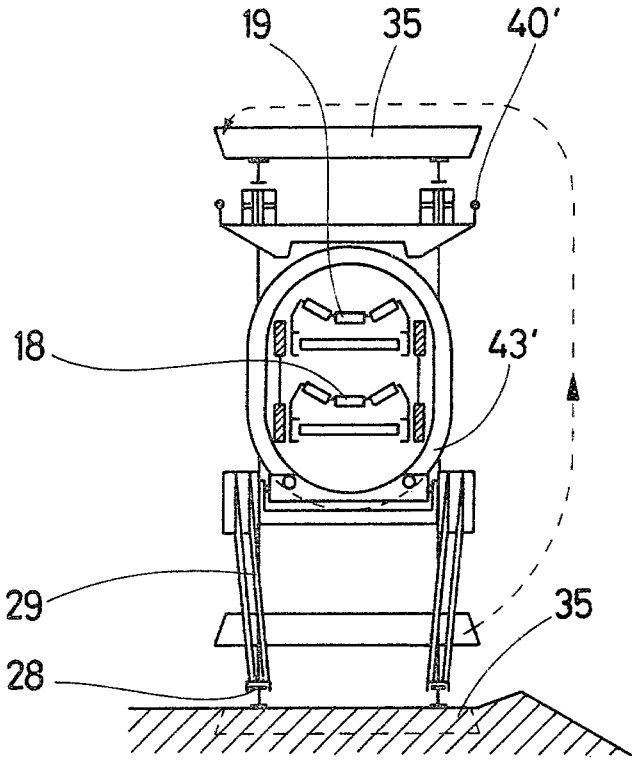
FIG. 11 illustrates an embodiment similar to that of FIG. 9 but for track panels.

2. A method for removing complete track panels or spans with the assistance of a rotary elevator 26 adapted to lift and turn the track panels upside down and to lay them upon lorries 41 rolling on a transport runway or In a modified version of this embodiment according to FIG. 11, the track removing car may be equipped with a rotary elevator 43' similar to FIG. 9, adapted to lift and rotate the track panels 35 by means of rolling claws 28 secured to hinged frames 29 (as in FIG. 8) both around the old ballast conveyor 18 and around the screened ballast conveyor so that the track panels are disposed upside down on lorries rolling on runway 40' above convey 19.

Figure 10:
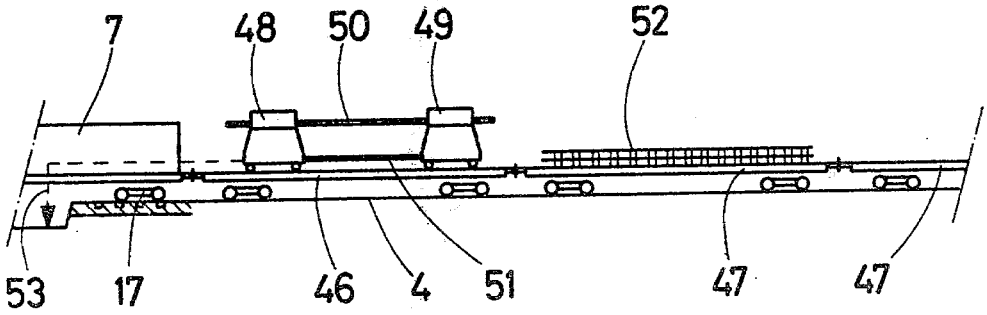
FIG. 10 is a schematic side elevation illustrating the general arrangement of the track relaying train.

The track panels may be removed without discontinuing the operation of the machine. During the picking up of the next track panel, the one stored on the ballast-clearing machine is moved forwards by another train of lorries until it reaches the laying car 7 where it is taken over by the gantries 48, 49 (FIG. 10) and transported on loading wagons.

Figure 1:
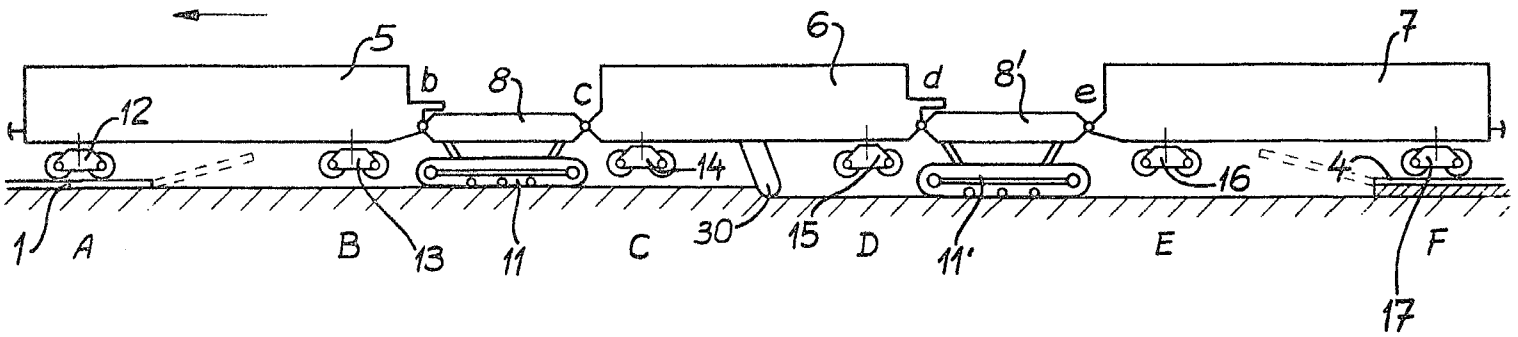
FIGS. 1 and 2 illustrate diagrammatically the general arrangement of a railroad track relaying train according to this invention.
Figure 2:
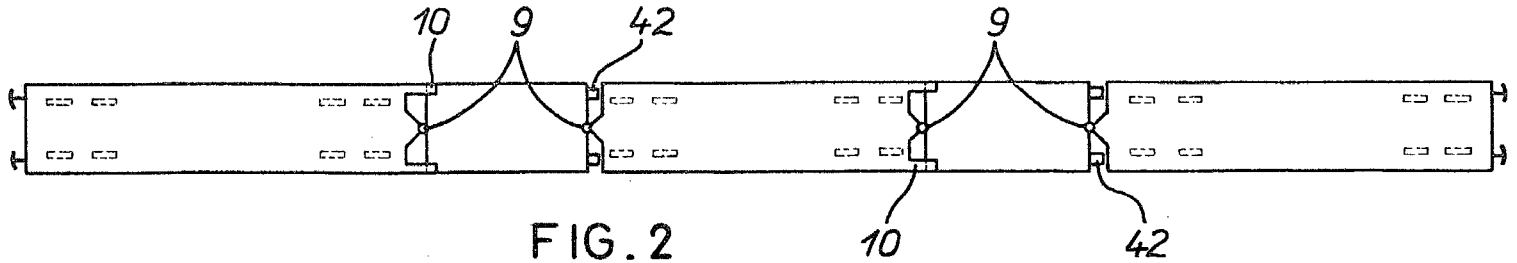

The ballast clearing car or machine 6 (FIG. 1) comprises a pair of bogie-trucks 14, 15, an excavator 30, a ballast metering unit and means for transporting the ballast, the track ties or the track spans or panels. This car 6 is coupled at its leading end to the track removing car 5 and at its trailing end to the track-laying car 7, both couplings occuring through a hinged connecting frame 8, 8' supported by a caterpillar truck 11, 11'. During the track relaying operations, the track clearing machine is supported by the pair of caterpillar trucks 11 and 11' running on the old ballast and the excavated truck platform, or on the screened ballast.

The excavator 30 comprises an excavating chain and an equalizing or levelling blade 25. The excavator is pivotally mounted on the frame and suspended by means of hydraulic cylinders so that the working depth and inclination of the platform can be adjusted at will. The blade is provided with side plates adjustable during the operation of the machine by means of hydraulic cylinders. Behind the levelling blade 25 a tamper is provided for compacting the track platform.

The material dug by the excavator is delivered by the excavating chains to conveyors 18 and thus directed towards the screener. The reclaimed and screened ballast is then directed by conveyors 19 to the rear end of the train and fed to the reclaimed-ballast metering device comprising a fixed bin and a metering element adjustable in the vertical direction as a function of the requisite thickness of the ballast layer. From the storage bin, the ballast is fed to the metering device to provide the first ballast layer and the excess ballast is delivered to an intermediate conveyor and thus fed to the ballast distributor mounted on the track laying car. Behind the ballast metering device a tamper is also provided for compacting the ballast before laying the ties.

The relatively long transport path followed by the old ballast and by the screened ballast along the train may become an inconvenience when the train is stopped for any reason during its operation. It would be necessary to stop all the conveyors carrying excavated and screened material for preventing an unequal distribution of the ballast beneath the laying car. Now starting all the loaded conveyors simultaneously would constitute a heavy demand of electric power and might delay the resumption of normal operations. To avoid these drawbacks, the present invention provides a transport connection established at will but preferably automatic each time the train is stopped. To this end, a hopper 31 located as close as possible to the excavating chain is disposed between the transport chains 18 for the old ballast and 19 for the screened ballast. The transport connection, creating a closed-circuit condition between the screened ballast and the used ballast, is obtained by shifting the screened ballast conveyor 19' with the assistance of a hydraulic cylinder 39 when the machine is stopped.

The track laying car 7 provided with two bogie-trucks 16 and 17 is equipped with tie-laying means, together with the conveyor elements, the rail laying members and the ballast distributor. During operation, the car 7 is caused to bear at its front end on the caterpillar-mounted connecting frame 8' and at its rear end on the bogie-truck 17 rolling on the new track 4. Also mounted on the rear portion of the car 7 are the new rails laying members comprising, inter alia, roller claws clamps or nippers.

The new ties 52 stored on transport wagons 47 are transferred by means of gantries 48, 49 to a storage conveyor 51 of the car 46 equipped with the tie-screw fitting means. An intermediate conveyor separates the ties and feeds them to rotary clamps disposed at the rear end of the track laying car 7. These clamps lift and turn two ties at a time, and lay them upon a longitudinal conveyor divided into several sections for the intermediate storage. The ties 52 are thus transferred by the longitudinal conveyor to the tie-laying machine where they are centered, positioned and finally laid upon the ballast, as shown schematically by arrow 53 in FIG. 10.

The relative spacing of the ties thus laid down is set by means of a measuring device adapted to change this spacing centimeter by centimeter. The ties are also positioned in the transverse direction either by means of a feeler controlling the distance between the tie axis and the parallel track or by means of a measuring system associated with adequate control means provided on the working car.

The tie-screw fitting car 46 (FIG. 10) comprises power-wrenches for fastening the new rails by means of tie-screws. Moreover, this car 46 is used for transporting the gantries 48 and 49. The dimensions of this car 46 are such that crew can fit the tie fastening means from inside the car.

The pair of self-propelled gantries 48 and 49 is constructed according to the teachings of Swiss Pat. No. 549.692, for transporting the old and new ties to and from the working cars and the transport cars 47. These two gantries 48, 49 are interconnected by a central girder from which a tie transporting beam is suspended by means of ropes and hydraulic cylinders. It also comprises hydraulically actuated claws for gripping the ties or the track spans.

The complete relaying of a railroad train according to the instant invention comprises the following operations:

I—Removing the old ties and rails.

Variant Ia:

Removing the rail fixing means in front of the machine;

Spreading the old rails apart, behind the front bogie-truck of the rail removing car, with the assistance of rolling claws;

Extracting the old ties by using the hydraulic excavator and transferring them through the chain conveyors and an elevator to the storage conveyor at the laying car.

Variant Ib:

Removing the old track panels or spans by means of the rotary elevator, then laying them upon the lorries and transporting them in two successive runs to the laying car.

II—Excavating the ballast, equalizing and compacting the track sub-grade or platform;

III—Screening the ballast by using a vibrating screen and a rotary screen; the reclaimed ballast is transported to the metering device behind the excavation chain and to the ballast distributor at the rear end of the track laying car; any refuse is either deposited laterally of the track platform or loaded into a special car;

IV—Laying the new ties by using the tie laying apparatus;

V—Laying the new rails on the ties by using rotary claws in front of the rear bogie-truck of the track-laying car;

VI—Transporting the old ties or, as the case may be, the old track spans or panels, by using the gantries equipping the transport car and supplying new ties by using the gantries from the transport car to the laying car;

VII—Fixing the rails by using the tie-screw fastening means contemplated.

What is claimed is:

1. A train for relaying railroad track in a relaying zone comprising:

(a) cars for transporting ties and fixing means, (b) a sequence of working cars comprising a car for removing old rails and ties, a ballast excavating car, and a track relaying car, (c) first conveyor means for transporting the excavated ballast toward a cleaning station on a car outside the relaying zone, (d) second conveyor means for transporting the cleaned ballast to a storage and distribution bin behind the excavation area for preparing new track, (e) first transport means for transporting the old ties, said first transport means being installed above at least said first conveyor means, (f) second transport means for transporting new ties, and (g) combined elevator and turning means for lifting at least one old tie laterally of at least said first conveyor means while turning it from transverse to longitudinal orientation and for moving it above the level of said first transport means.

2. A railroad track relaying train according to claim 1, in which said combined elevator and turning means comprises a pivoting arm for turning at least one tie first from transverse to longitudinal orientation and then, after having passed said first conveyor means, turning it back to transverse orientation before depositing it on said first transport means.

3. A railroad track relaying train according to claim 1, further comprising means for directing ballast from said second conveyor means to said first conveyor means when said train is stopped.

4. A train for relaying railroad track in a relaying zone comprising:

(a) cars for transporting ties and fixing means, (b) a sequence of working cars comprising a car for removing old rails and ties or track panels, a ballast excavating car, and track relaying car, (c) first conveyor means for transporting the excavated ballast toward a cleaning station on a car outside the relaying zone, (d) second conveyor means for transporting the cleaned ballast to a storage and distribution bin behind the excavation area for preparing new track, (e) first transport means for transporting the old ties or old track panels, said first transport means being installed above at least said first conveyor means, (f) second transport means for transporting new ties, and (g) rotary elevator means for old ties or track panels, said elevator means being installed on said removing car and comprising means for lifting old ties or old track panels while turning them around said first conveyor means along an arched path and depositing them upon said first transport means.

5. A railroad track relaying train according to claim 4, in which said rotary elevator means deposits said old ties or old track panels upside down on said first transport means.

6. A railroad track relaying train according to claim 4, in which said rotary elevator means is suspended from a longitudinal girder, whereby a complete track panel can be lifted and rotated around said first conveyor means in order to lay said complete track panel longitudinally and flat upon said first transport means.

7. A railroad track relaying train according to claim 4, in which said rotary elevator means comprises means for lifting a complete track panel and rotating same around said first and second conveyor means and then laying said track panel longitudinally and flat on said first transport means.

* * * * *